US007462000B2

(12) United States Patent
Leverette et al.

(10) Patent No.: US 7,462,000 B2
(45) Date of Patent: Dec. 9, 2008

(54) BATTERED COLUMN TENSION LEG PLATFORM

(75) Inventors: Steven J. Leverette, Richmond, TX (US); Oriol R. Rijken, Houston, TX (US); Peter A. Lunde, Cypress, TX (US)

(73) Assignee: Seahorse Equipment Corporation, Houston, TX (US)

( * ) Notice: Subject to any disclaimer, the term of this patent is extended or adjusted under 35 U.S.C. 154(b) by 0 days.

(21) Appl. No.: 11/364,505

(22) Filed: Feb. 28, 2006

(65) Prior Publication Data

US 2007/0201954 A1 Aug. 30, 2007

(51) Int. Cl.
*B63B 35/44* (2006.01)

(52) U.S. Cl. ..... 405/223.1; 405/224; 114/164

(58) Field of Classification Search ..... 405/195.1, 405/223.1, 224, 224.2; 114/264–266
See application file for complete search history.

(56) References Cited

U.S. PATENT DOCUMENTS 3,556,033 A * 1/1971 Bonnafous ..... 114/265
3,577,946 A * 5/1971 Horton ..... 405/223.1
3,841,249 A * 10/1974 Vilain ..... 114/265
4,481,899 A * 11/1984 Einstabland et al. ..... 405/195.1
4,784,529 A * 11/1988 Hunter ..... 405/223.1
4,793,738 A * 12/1988 White et al. ..... 405/223.1
6,447,208 B1 * 9/2002 Huang et al. ..... 405/223.1
6,997,132 B2 * 2/2006 Steen ..... 114/265
7,011,472 B2 * 3/2006 Martensson et al. ..... 114/265
7,117,810 B2 * 10/2006 Kristensen et al. ..... 114/265
2001/0026733 A1 * 10/2001 Ludwigson ..... 405/224.2
2006/0260526 A1 * 11/2006 Kristensen et al. ..... 114/264

* cited by examiner

*Primary Examiner*—Frederick L Lagman
(74) *Attorney, Agent, or Firm*—Nick A. Nichols, Jr.

(57) ABSTRACT

A tension leg platform includes a deck supported on the upper ends of three or more columns interconnected at the lower ends thereof by horizontally disposed pontoons. The columns are battered inwardly and upwardly from the pontoons to the deck. Tendons connected at the columns anchor the platform to the seabed. The footprints of the base of the battered columns and the tendons are larger than the footprint of the deck supported on the upper ends of the columns.

13 Claims, 6 Drawing Sheets

BATTERED COLUMN TENSION LEG PLATFORM

BACKGROUND OF THE DISCLOSURE

The present invention relates to offshore floating platforms, more particularly to a tension leg platform (TLP) for installation in water depths from less than 1,000 to 10,000 ft.

TLPs are floating platforms that are held in place in the ocean by means of vertical structural mooring elements (tendons), which are typically fabricated from high strength, high quality steel tubulars, and include articulated connections on the top and bottom (tendon connectors) that reduce bending moments and stresses in the tendon system. Many factors must be taken into account in designing a TLP to safely transport the TLP to the installation site and keep it safely in place including: (a) limitation of stresses developed in the tendons during extreme storm events and while the TLP is operating in damaged conditions; (b) avoidance of any slackening of tendons and subsequent snap loading or disconnect of tendons as wave troughs and crests pass the TLP hull; (c) allowance for fatigue damage which occurs as a result of the stress cycles in the tendons system throughout its service life; (d) limit natural resonance (heave, pitch, roll) motions of the TLP to ensure adequate functional support for personnel, equipment, and risers; (e) maximizing the hydrostatic stability of the TLP during transport and installation; and (e) accommodating additional requirements allowing for fabrication, transportation, and installation.

These factors have been addressed in the prior art with varying degrees of success. Conventional multi-column TLP's generally have four vertical columns interconnected by pontoons supporting a deck on the upper ends of the vertical columns. Tendons connected at the lower ends of the columns anchor the TLP to the seabed. In such conventional TLP designs, the footprints of the deck, the vertical columns and the tendons are substantially the same and therefore hydrostatic stability of the TLP can be a problem. Some TLP designs address this problem by incorporating pontoons and/or structures that extend outboard of the column(s) to provide a larger tendon footprint limit natural resonance (heave, pitch, roll) motions of the TLP. In U.S. Pat. No. 6,447,208, a TLP having an extended base substructure is disclosed. Vertical columns supporting a deck on the upper ends thereof form the corners of the substructure. A plurality of wings or arms extends radially out from the outer perimeter of the substructure. The arms increase the radial extension of the base substructure between about 10% and about 100%. The arms include tendon connectors affixed at the distal ends thereof for connection with tendons anchoring the TLP to the seabed. The tendons footprint is substantially larger than the footprint of the substructure.

The present invention, in its various embodiments, addresses the above-described factors to accommodate different payload requirements, various water depths and to improve TLP response. Improvement of TLP performance may be obtained by battering the deck support columns, thereby reducing tendon tension reactions, increasing the free floating stability of the TLP, and reducing overall system costs.

SUMMARY OF THE INVENTION

In accordance with a preferred embodiment of the present invention, a tension leg platform includes a deck supported on the upper ends of at least three columns interconnected at the lower ends thereof by horizontally disposed pontoons. The columns are battered inwardly from the pontoons to the deck. Tendons connected at porches extending outwardly from the lower ends of the columns anchor the platform to the seabed. The footprint of the tendons is substantially the same or slightly larger than the footprint of the battered columns, whereas the footprint of the deck is smaller than the footprint of the columns. The battered columns also contribute to platform stability during free floating operations by providing a large water plane dimension at shallow draft.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
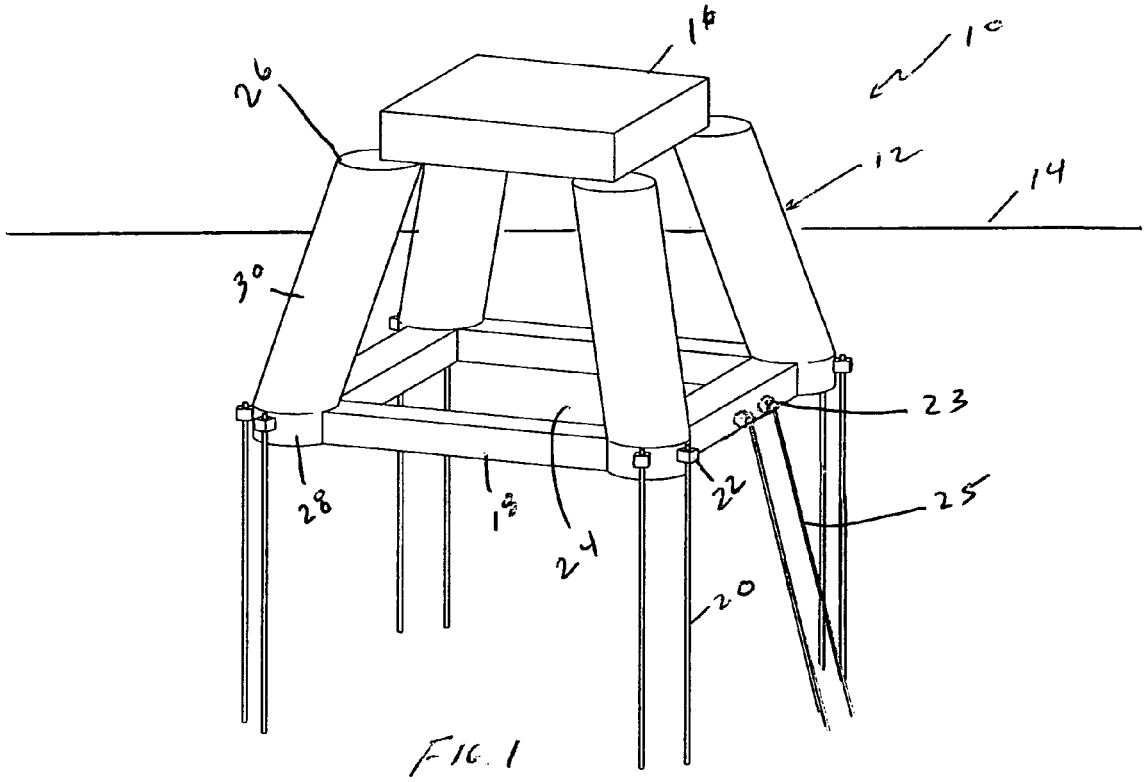
FIG. 1 is a perspective view illustrating a preferred embodiment of a battered column tension leg platform of the present invention.

Referring first to FIG. 1, a preferred embodiment of a TLP system in accordance with the present invention is generally identified by the reference numeral 10. The TLP 10 includes four columns 12 having upper ends projecting above the water surface 14 for engaging and supporting a platform deck 16 thereon. Horizontally disposed pontoons 18 interconnect adjacent columns 12 proximate the lower ends thereof. The TLP 10 is anchored to the seabed by tendons 20. The upper ends of one, two or more tendons 20 are connected at each column 12 and the lower ends thereof are anchored to the seabed. Tendon porches 22 mounted proximate to and outboard of the lower ends of the columns 12 secure the tendons 20 to the columns 12.

The columns 12 and pontoons 18 form an open structure hull for supporting the deck 16 and the equipment mounted thereon above the water surface 14. The deck 16 is supported above the water surface 14 on the upper ends 26 of the columns 12. The open structure of the columns 12 and pontoons 18 provides improved wave transparency and further defines a moonpool 24 providing access to the seabed from the deck 16. The columns 12 form the corners of the hull and are battered or inclined inwardly toward the central longitudinal axis of the hull. Preferably, the columns 12 are battered inwardly at an angle less than 20 degrees from vertical Referring still to FIG. 1, the columns 12 include a substantially vertical section 28 forming the lower ends of the columns 12 and an inclined or battered section 30 terminating at the upper ends 26 of the columns 12. The lower ends 28 of the columns 12 provide a vertical perimeter structural surface for connection of the pontoons 18 thereto. The tendon porches 22 are fixed to and extend outward from the lower ends 28 of the columns 12. Connectors 23 may be fixed to and extend outward from the pontoons 18 for supporting risers 25, flow lines or the like from the pontoons 18. In addition, the TLP 10 may be provided with one or more catenary mooring lines or one or more lateral mooring lines to compensate for the weight of any risers or midwater pipelines connected to the TLP 10.

Figure 2:
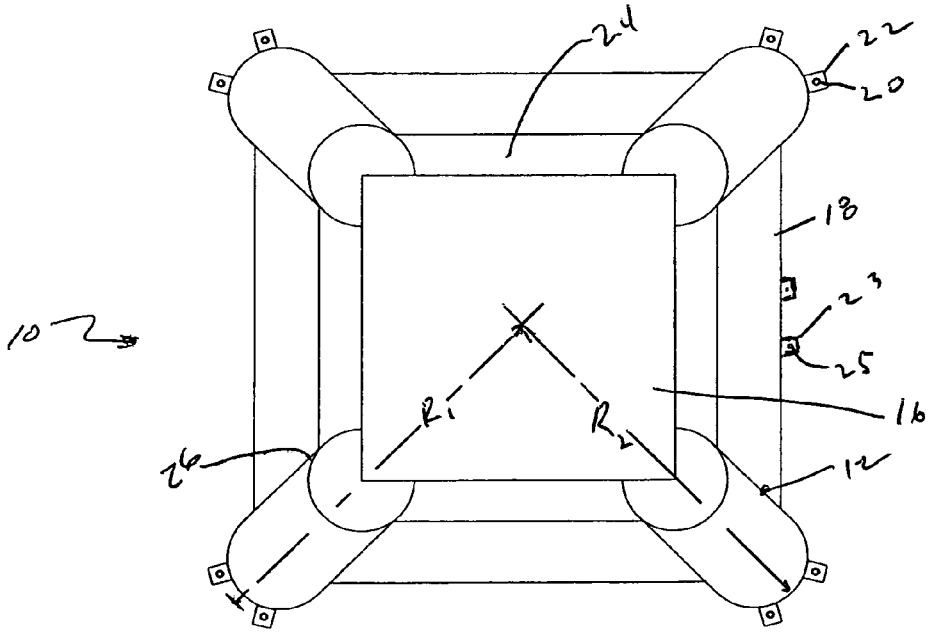
FIG. 2 is a top view of the battered column tension leg platform shown in FIG. 1.

The payload capacity of a TLP system is controlled by the displacement of the structure, as well as the ability of the system to resist overturning moments due to wind, waves, and current. The overturning resistance is lost when a tendon goes slack. For a given displacement and pretension, the overturning resistance is increased by having a larger horizontal plan baseline, i.e., a larger distance between tendons. In a conventional four column TLP, the deck is supported by vertical columns interconnected by pontoons or similar structural members. Consequently, the perimeter dimensions or footprints of the deck and the vertical support columns of a conventional TLP are about equal. The tendon plan dimension is limited to much this same perimeter dimension. The overturning capacity of the TLP is therefore limited by the overall dimensions of the deck and columns. This limitation is overcome by the TLP 10 of the present invention by battering the columns 12 so that the columns 12 footprint, defined by the perimeter dimension of the lower ends 28 of the columns 12, is larger than the deck 16 footprint defined by the perimeter dimension of the upper ends 26 of the columns 12. Also the battered columns 12 provide an efficient load transfer path for balancing deck weight, hull buoyancy, and tendon tension loads. All loads are direct acting through the columns 12, without large cantilevers or large structural moments. As best shown in FIG. 2, the radial distance $R_1$ of the tendons 20 footprint from the central longitudinal axis of the TLP is substantially equal to or slightly greater than the radial distance $R_2$ of the columns 12 footprint. Since the moment force generated by the tendons 20 increases as the radial distance $R_1$ of the tendons 20 increases, minimizing the difference in radial distance between the columns 12 footprint and the tendons 20 footprint is desirable. Preferably, the radial distance $R_1$ of the tendons 20 footprint is less than 10% greater than the radial distance $R_2$ of the columns 12 footprint, thereby minimizing the tendons 20 moment force.

Figure 3:
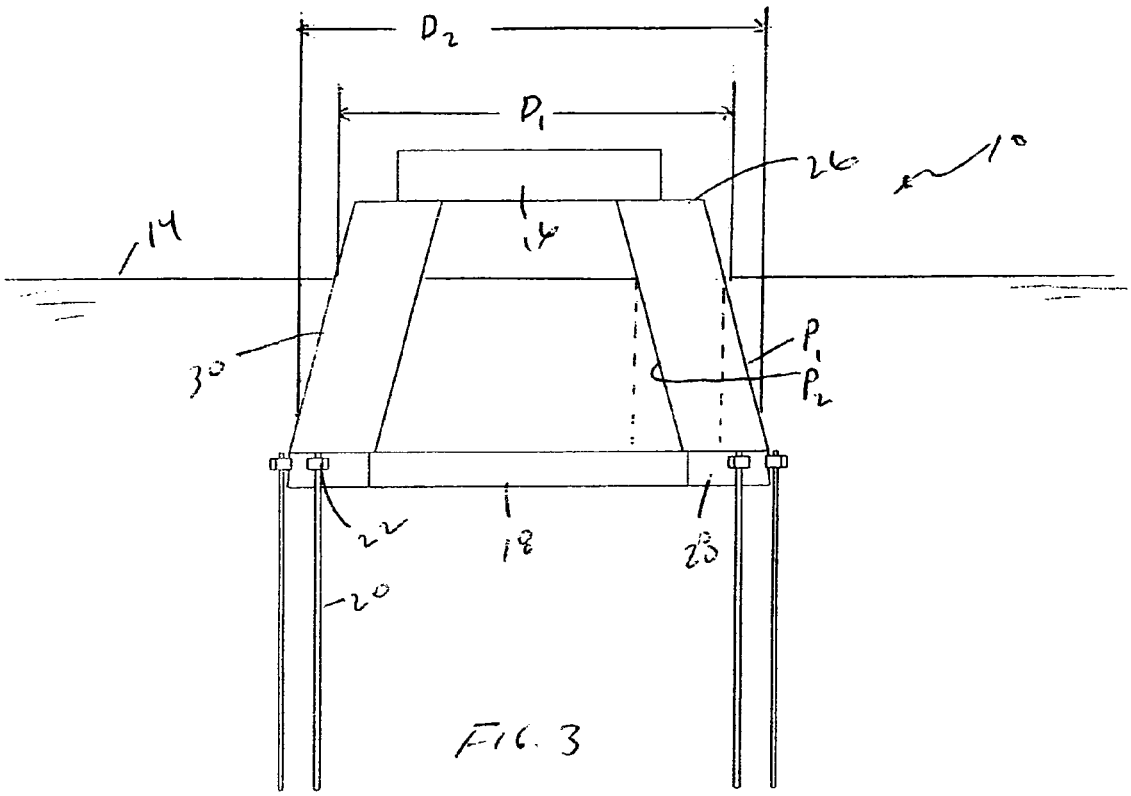
FIG. 3 is a side view of the battered column tension leg platform shown in FIG. 1.

Various modes of transportation may be utilized to transport the TLP or components thereof to the installation site. When the hull and deck are assembled at the fabrication yard, the hull-and-deck assembly may be free floated to the installation site. For free floating conditions of the hull-and-deck assembly (such as deck integration, loading and unloading from a transport vessel, and towing to the installation site), hydrostatic stability is most lacking at shallow draft when the vertical center of gravity of the hull-and-deck assembly is high. The battered columns 12 of the TLP 10 provide a larger water plane dimension at shallower drafts of the free floating hull-and-deck assembly than a conventional TLP with vertical columns. As best illustrated in FIG. 3, the water plane dimension of the hull-and-deck assembly at the water surface 14 for a first draft position is represented by the line $D_1$. At a shallower second draft position, the larger water plane dimension of the hull-and-deck assembly is represented by the line $D_2$. Unlike the water plane dimension of a conventional TLP, which is the same at all drafts, the water plane dimension of the TLP 10 increases at shallower drafts of the free floating hull-and-deck assembly. The battered columns 12 therefore provide additional water plane dimension for maximizing TLP stability at shallower drafts where it is most needed, and thereby maximizing the payload capacity of the deck 16 during free floating phases of the TLP.

The balancing of hydrodynamic loads in waves is another aspect of the design of TLPs, semisubmersibles, and other column/pontoon structures. These platforms are typically optimized with regard to the ratio of volumes of surface piercing structure (vertical columns) and submerged structure (pontoons) in order to minimize the vertical forcing of waves. Under the crest of a wave, the upward force on the surface piercing structure is maximum upward, while the upward force on a submerged structure is maximum downward. Under a wave trough these are reversed. This balance is affected by the draft of the structure and the period of waves. Normally a structure is designed to have the vertical forces balanced and canceling in the most energetic wave periods. For a TLP, these are not the only forces acting, nor the only constraints on geometry, and the final design is a compromise of many factors of which this is one. However, for battered columns, the column begins to have pontoon characteristics with increasing batter. This may be used in the balancing of the structural proportions of the hull in order to provide best performance in waves for a particular site.

As noted above, inclination of the columns 12 imparts pontoon-like properties to the columns 12 which may be best understood by visualizing a horizontal cross section through the columns 12 at the water surface 14 and a shadow (shown in phantom in FIG. 3) formed by the sun located directly above. The portion $P_1$ of the columns 12 that is not under the shadow of the surface water plane has water acting both above and below, whereas the portion $P_2$ of the columns 12 that is under the shadow of the surface water plane has water acting only from below. The balance between the surface piercing buoyancy of the columns 12 and the non-surface piercing buoyancy of the pontoons 18 may therefore be modified without changing the actual dimensions of the columns 12 and pontoons 18 by increasing or decreasing the draft of the TLP 10.

Figure 4:
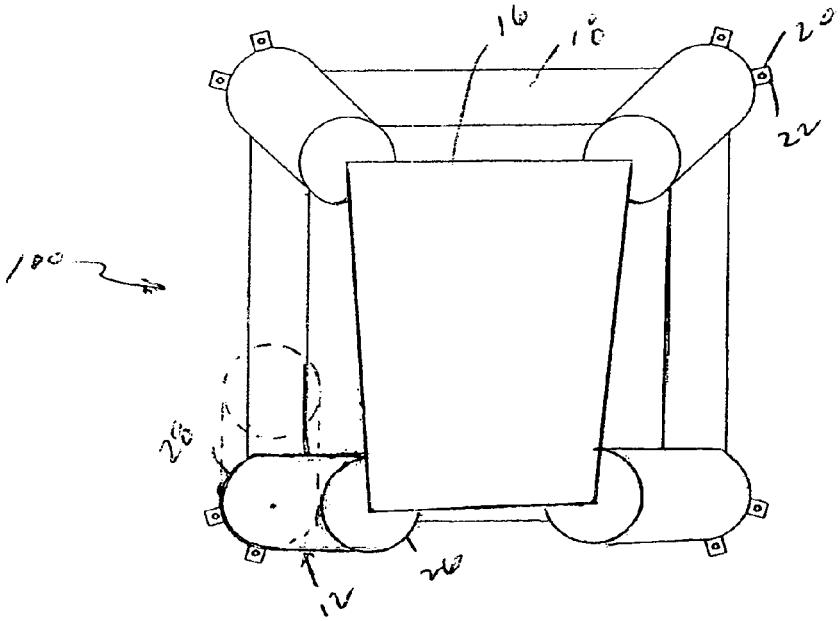
FIG. 4 is a top view of another preferred embodiment of a battered column tension leg platform of the present invention.

Referring now to FIG. 4, another embodiment of the battered column TLP of the present invention is generally identified by the reference numeral 100. The TLP 100 is substantially the same as the TLP 10 described hereinabove with the exception that two of the columns 12 are battered toward each other above the pontoons 18. It is understood however that the columns 12 may be inclined inwardly in any radial direction between 0° (shown in solid line) and 90° (shown in phantom). Thus, the TLP design of the present invention may accommodate various sizes and shapes of the deck 16 and payload capacity without changing the actual dimensions of the columns 12 and the pontoons 18.

Figure 5:
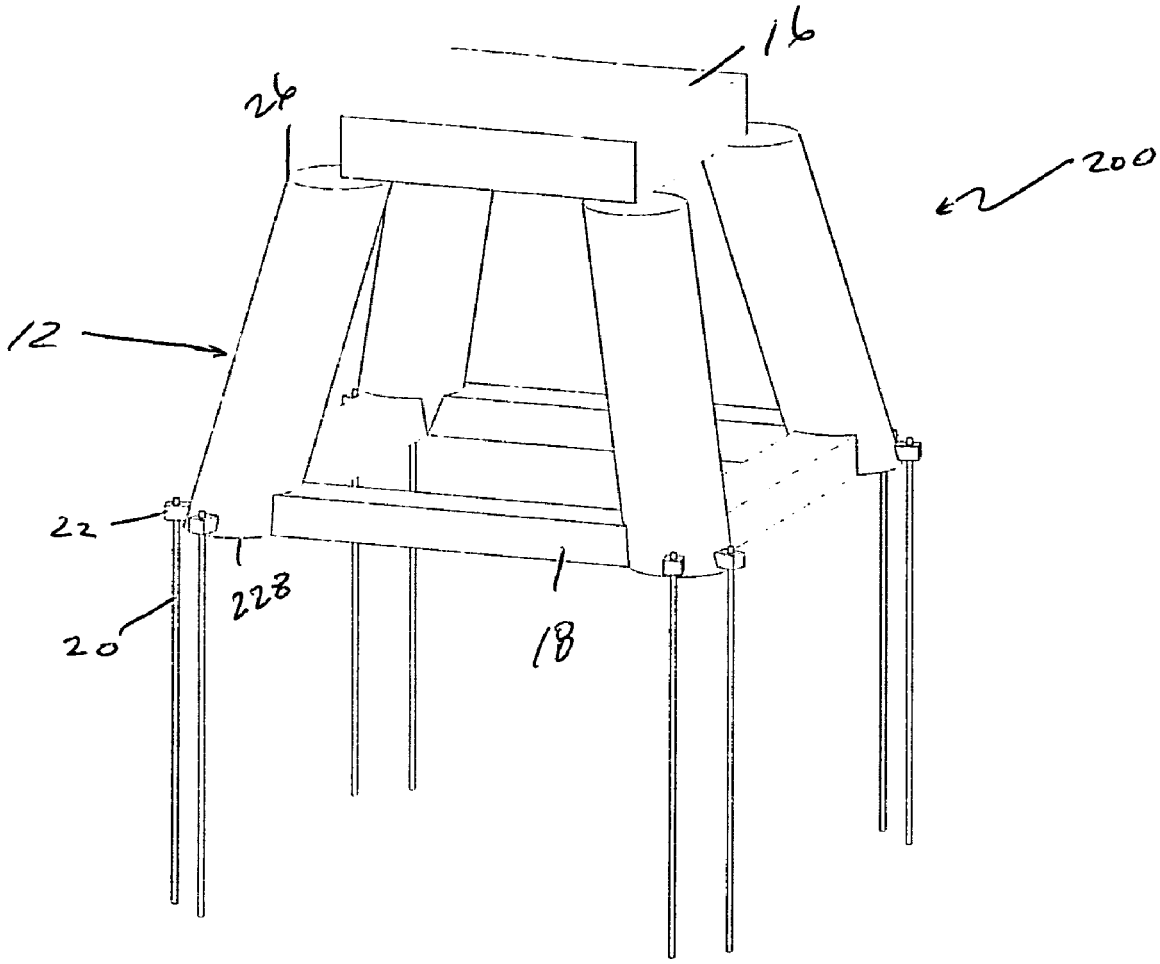
FIG. 5 is a perspective view illustrating another preferred embodiment of a battered column tension leg platform of the present invention.

Referring now to FIG. 5, another embodiment of the battered column TLP of the present invention is generally identified by the reference numeral 200. The TLP 200 is substantially the same as the TLP 10 described hereinabove with the exception that the lower ends of the columns 12 do not include a vertical dimension. The columns 12 illustrated in FIG. 4 are inclined inwardly from the lower ends 228 to the upper ends 26 thereof.

Figure 6:
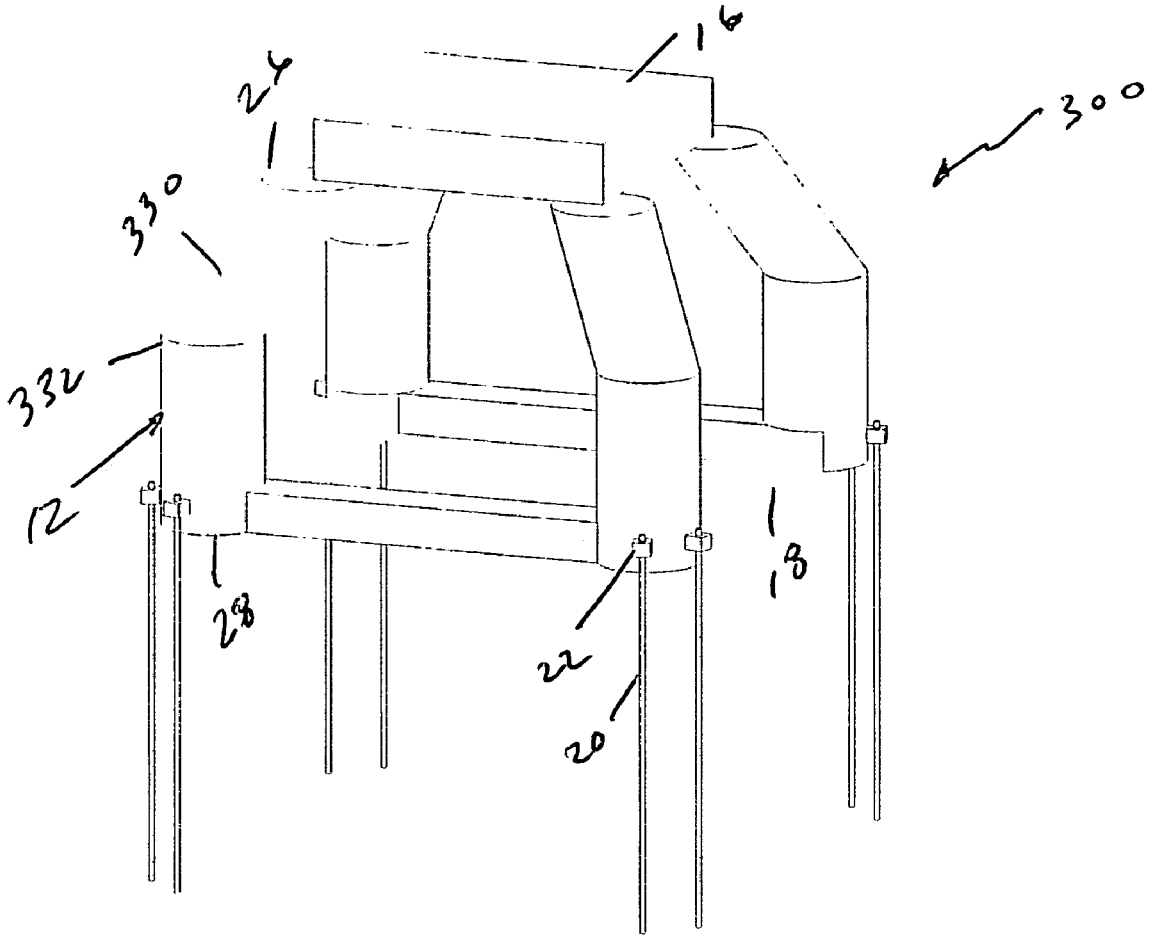
FIG. 6 is a perspective view illustrating another preferred embodiment of a battered column tension leg platform of the present invention.

Referring now to FIG. 6, another embodiment of the battered column TLP of the present invention is generally identified by the reference numeral 300. The TLP 300 is substantially the same as the TLP 10 described hereinabove with the exception that the columns 12 include a battered section 330 extending inwardly from an intermediate point 332 between the upper ends 26 and the lower ends 28 of the columns 12.

Figure 7:
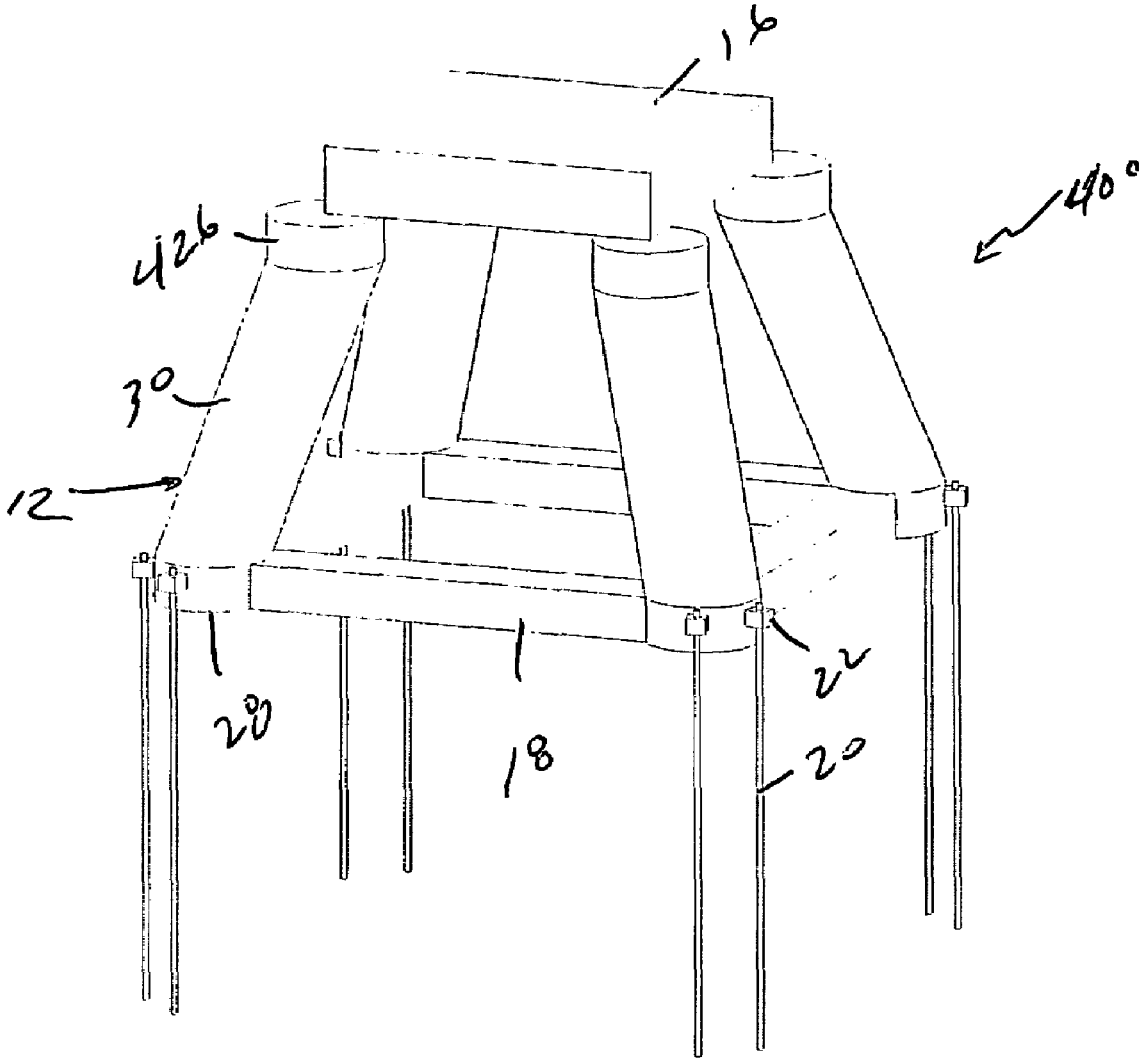
FIG. 7 is a perspective view illustrating another preferred embodiment of a battered column tension leg platform of the present invention.

Referring now to FIG. 7, another embodiment of the battered column TLP of the present invention is generally identified by the reference numeral 400. The TLP 400 is substantially the same as the TLP 10 described hereinabove with the exception that the columns 12 include a substantially vertical section 426 forming the upper ends of the columns 12 and an inclined or battered section 430 extending between the upper ends 226 and the lower ends 28 of the columns 12.

Figure 8:
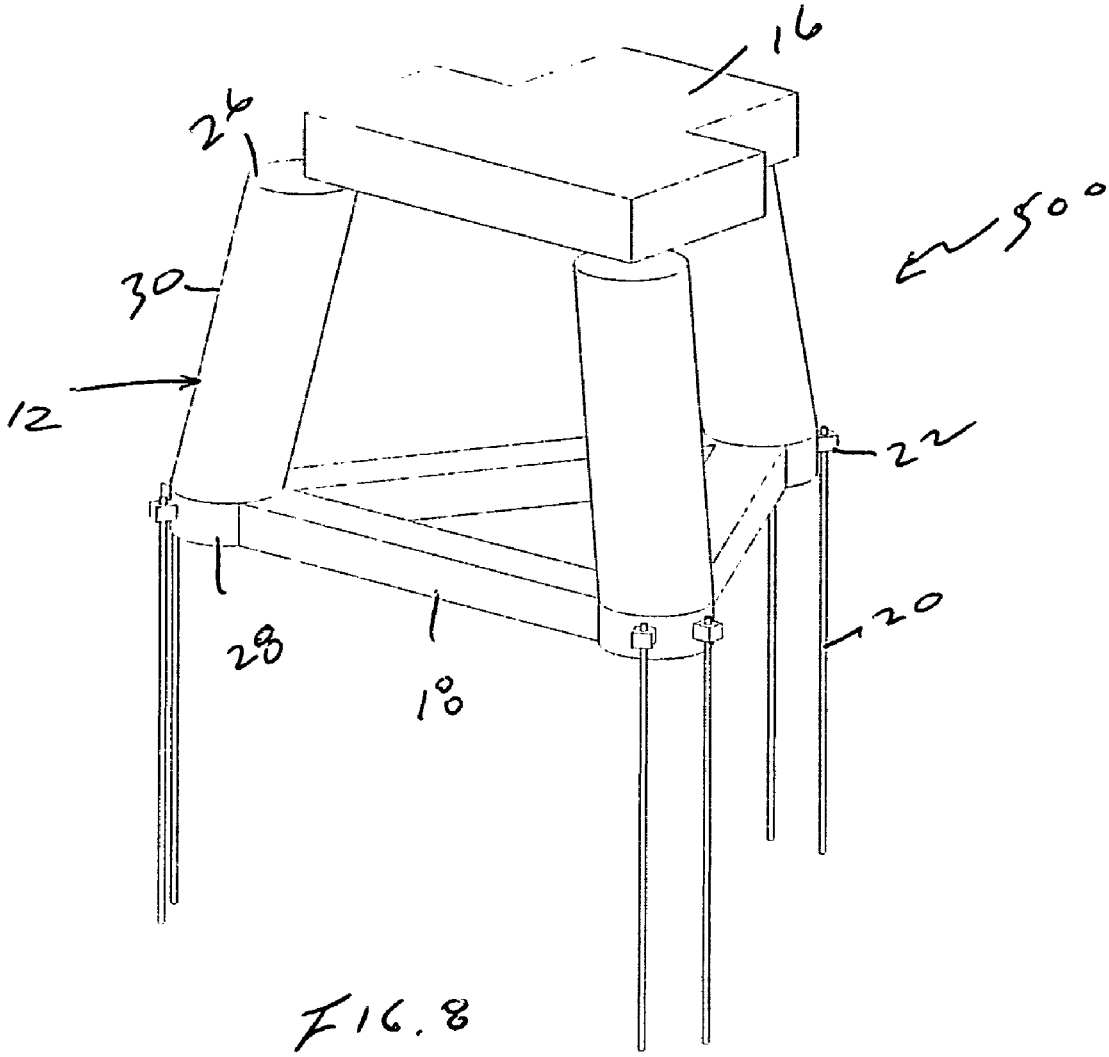
FIG. 8 is a perspective view illustrating another preferred embodiment of a battered column tension leg platform of the present invention.

Referring now to FIG. 8, another embodiment of the battered column TLP of the present invention is generally identified by the reference numeral 500. The TLP 500 is substantially the same as the TLP 10 described hereinabove with the exception that the hull of the TLP 500 comprises three battered columns 12 interconnected by the pontoons 18 at the lower ends 28 and supporting the deck 16 at the upper ends 26 thereof.

It will be observed that the columns 12 and pontoons 18 are depicted as cylindrical members in the various embodiments of the present invention. However, it is to be understood that the disclosed embodiments are merely exemplary of the invention that may be embodied in various and alternative forms and not intended to be limiting.

While a preferred embodiment of the invention has been shown and described, other and further embodiments of the invention may be devised without departing from the basic scope thereof, and the scope thereof is determined by the claims which follow.

The invention claimed is:

1. A floating platform, comprising:

a) three or more battered buoyancy columns having upper and lower ends;

b) a deck supported above a water surface on said upper ends of said battered columns;

c) horizontally disposed pontoons interconnecting said battered columns proximate said lower ends thereof;

d) one or more tendon members having one end connected to said lower ends of said battered columns and an opposite end anchored to the seabed; and e) wherein said tendon members are located a first radial dimension from a central vertical axis of said platform and said lower ends of said battered columns are located a second radial dimension from the central vertical axis of said platform, wherein said first radial dimension is less than 10% greater than said second radial dimension.

2. The platform of claim 1 wherein said upper ends of said battered columns support said deck above the water surface inboard of said pontoons.

3. The platform of claim 1 wherein said battered columns incline inwardly at an angle less than 20 degrees from vertical.

4. The platform of claim 1 wherein said battered columns define a water plane moment at the water surface, and wherein said water plane moment is largest at a shallow draft of said platform.

5. The platform of claim 1 wherein said battered columns include pontoon-like buoyancy characteristics.

6. The platform of claim 1 wherein said battered columns incline inwardly from an intermediate point between said upper and lower ends of said battered columns.

7. The platform of claim 1 wherein said lower ends of said battered columns define a substantially vertical perimeter surface.

8. The platform of claim 7 wherein said upper ends of said battered columns define a substantially vertical perimeter surface.

9. The platform of claim 1 wherein said upper ends of said battered columns define a substantially vertical perimeter surface.

10. The platform of claim 1 wherein one or more of said battered columns incline in a direction toward an adjacent one of said columns.

11. The platform of claim 1 wherein at least two of said battered columns incline toward each other and extend above an interconnecting pontoon from proximate said lower ends of said battered columns to said deck.

12. The platform of claim 1 wherein said battered columns incline inwardly toward the center vertical axis of said platform at an angle less than ninety degrees.

13. The platform of claim 1 including riser connectors secured to an inner or outer perimeter of said pontoons.

* * * * *